US007138066B2

(12) United States Patent
Lev et al.

(10) Patent No.: US 7,138,066 B2
(45) Date of Patent: Nov. 21, 2006

(54) GEAR SURFACE TREATMENT PROCEDURE

(75) Inventors: Leonid C. Lev, West Bloomfield, MI (US); Michael J. Lukitsch, Marysville, MI (US); Yang-Tse Cheng, Rochester Hills, MI (US); Anita M. Weiner, West Bloomfield, MI (US); Robert F. Paluch, Allenton, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/180,428

(22) Filed: Jul. 13, 2005

(65) Prior Publication Data

US 2006/0131185 A1 Jun. 22, 2006

Related U.S. Application Data

(60) Provisional application No. 60/636,660, filed on Dec. 16, 2004.

(51) Int. Cl.
*B44C 1/22* (2006.01)
*C03C 15/00* (2006.01)

(52) U.S. Cl. ..... 216/57; 216/94; 216/96; 216/100; 134/2; 134/3; 134/4; 134/26; 205/662

(58) Field of Classification Search ..... 216/57, 216/94, 96, 100; 134/2, 3, 4, 26; 205/662
See application file for complete search history.

(56) References Cited

U.S. PATENT DOCUMENTS 3,856,635 A * 12/1974 Brown ..... 205/73
4,070,884 A 1/1978 Grube et al.
4,968,397 A * 11/1990 Asher et al. ..... 205/710
5,256,316 A 10/1993 Kenichi et al.
6,828,285 B1 12/2004 Nakamura

* cited by examiner

*Primary Examiner*—Shamim Ahmed
(74) *Attorney, Agent, or Firm*—Kathryn A. Marra

(57) ABSTRACT

A method of surface treating heat treated members to remove oxide scale. The heat treated members are subjected to a staged series of discrete chemical and physical cleaning steps yielding a substantially scale-free surface readily adaptable for subsequent application of protective coatings.

19 Claims, 2 Drawing Sheets

FIG. —1—

PRIMARY CHEMICAL CLEANING

GEAR SURFACE TREATMENT PROCEDURE

CROSS-REFERENCE TO RELATED APPLICATIONS

This application claims the benefit of and priority from U.S. provisional application No. 60/636,660 filed Dec. 16, 2004.

TECHNICAL FIELD

The present invention relates generally to gears and to the treatment thereof to increase wear resistance. More particularly, the invention relates to improved procedures for treating gear substrate surfaces to aid in acceptance and retention of applied wear resistant coatings.

BACKGROUND OF THE INVENTION

Gears have long been used in automobiles and other machines to transfer applied torque between components. Gears are often formed as wheels, worm wheels or linear racks incorporating protruding surfaces or teeth configured to engage cooperating surfaces within the assembly. Through this engagement, power is transferred between the components.

Gears are typically formed by casting or forging a desired gross shape from a suitable metal alloy and then cutting teeth by machining operations such as hobbing or shaving. Hardenable ferrous alloys are often used in the production of gears due to their ability to be hardened by heat treating techniques subsequent to initial formation. Heat treating is normally carried out by subjecting the machined part to an elevated temperature under a controlled treatment atmosphere rich in carbon and/or other treatment constituents for a predetermined period of time so as to allow infusion of the treatment constituents to at least a predefined depth. The part then normally undergoes an oil quench to lock in the heat treat characteristics. Such treatments substantially increase the surface hardness of the part.

The heat treating operations used typically leave layers of scale on the surface of the treated part. This scale may be made up of a combination of iron oxide, baked on oil, soot and other impurities. Such scale must be removed prior to the application of any protective coatings to the gear. In the past, it has been found difficult to efficiently clean the scale from gears to suitable levels for subsequent application of protective coatings without risk of damaging the gear surface.

SUMMARY OF THE INVENTION

The present invention provides advantages and/or alternatives over the known art by providing a process by which heat treated gears or other parts are subjected to a staged series of discrete cleaning steps yielding a substantially scale-free surface readily adaptable for subsequent application of protective coatings.

BRIEF DESCRIPTION OF THE DRAWINGS

The following drawings which are incorporated in and which constitute a part of this specification illustrate exemplary processes according to the present invention and, together with the description set forth below, serves to explain the principles of the invention wherein.

While a description will hereinafter be provided in connection with the illustrated flow diagram and certain potentially preferred procedures, it is to be understood and appreciated that in no event is the invention to be limited to such procedures as may be illustrated and described herein. On the contrary, it is intended that the present invention shall extend to all alternatives and modifications as may embrace the broad principles of this invention within the true spirit and scope thereof.

DESCRIPTION OF THE PREFERRED EMBODIMENT

Figure 1:
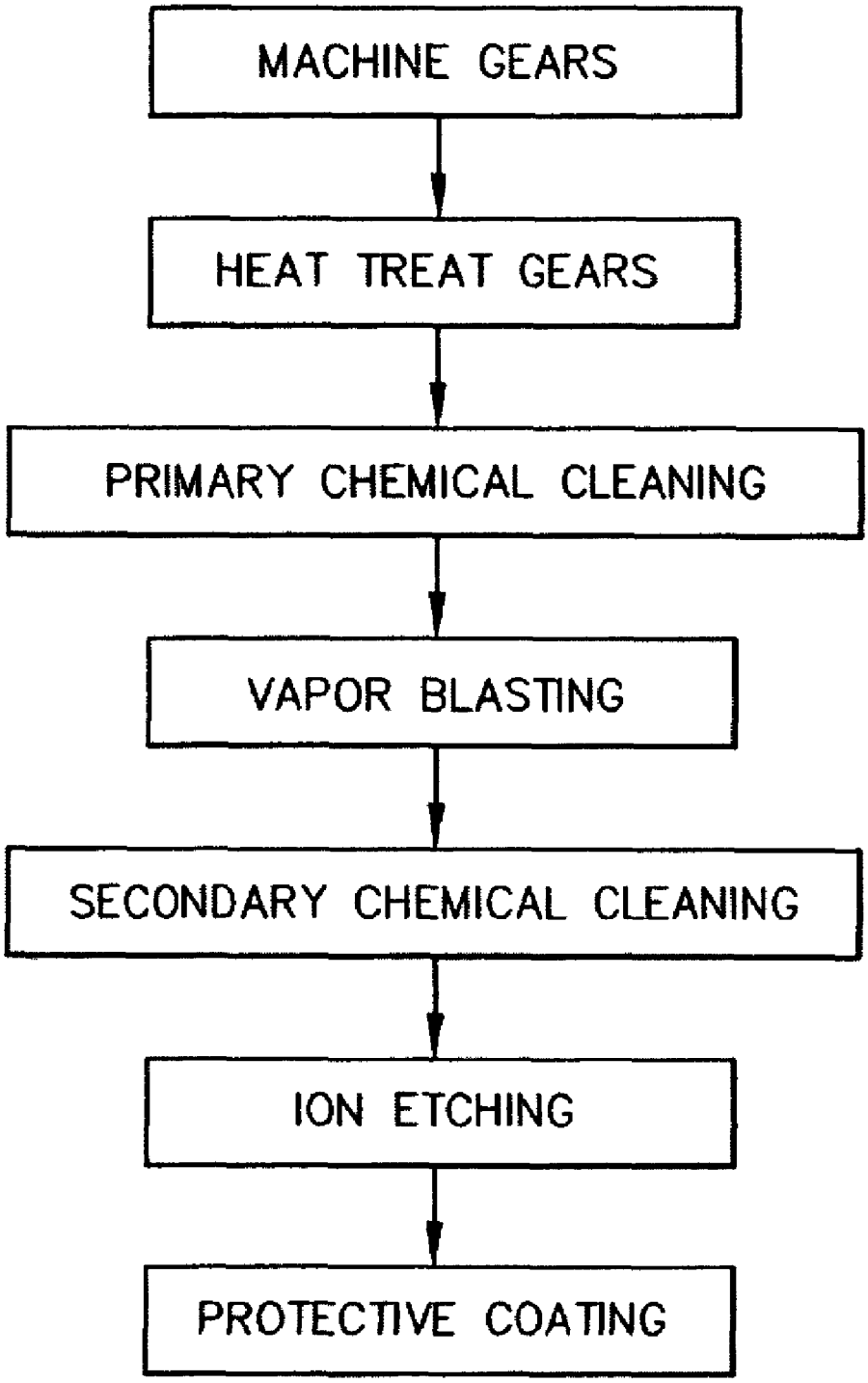
FIG. 1 is a block diagram illustrating the treatment steps in an exemplary process for preparing heat treated gears.

Referring now to FIG. 1, in the illustrated practice a preliminary step preferably involves machining gears of ferrous alloy material or the like by operations such as hobbing and shaving so as to form a desired arrangement of protruding gear teeth. Following the machining operation, the gears are thereafter subjected to a commercial heat treatment to increase hardness and wear resistance. During the heat treatment the gear may be carburized and/or carobnitrided and/or subjected to other treatments as may be desired. Upon completion of the heat treatment the gear is typically at least partially covered with a tenaciously adhering scale which must be removed prior to the application of any coating that may be desired. In order to efficiently and effectively remove the scale, the gear is preferably subjected to a multi-step cleaning process providing a combination of chemical and mechanical cleaning without damaging the gear substrate.

Figure 2:
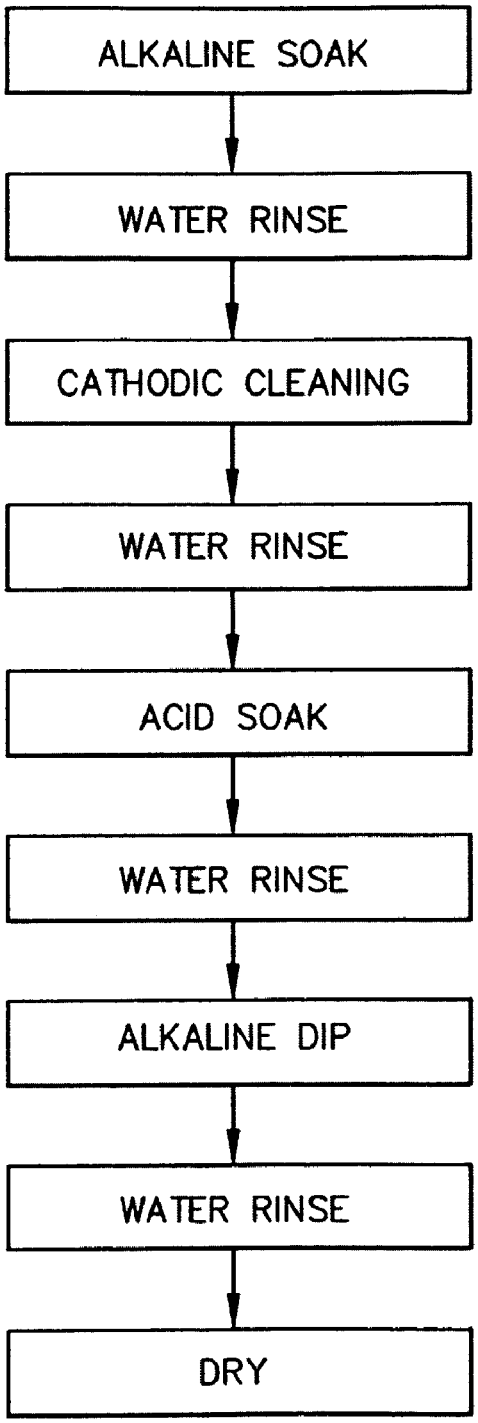
FIG. 2 is a block diagram illustrating the steps in an exemplary primary chemical cleaning procedures as part of the exemplary process set forth in FIG. 1.

As an initial step in the cleaning process the gear with adhered scale is subjected to an initial or primary chemical cleaning incorporating a galvanic or cathode cleaning as well as an acid etch to partially dissolve and effectively soften the scale. A block diagram setting forth an exemplary primary chemical cleaning procedure is set forth at FIG. 2. By way of example only, and not limitation, the primary chemical cleaning preferably involves soaking the gear in a standard alkaline soak cleaner for about fifteen minutes followed by rinsing in water. Following soaking, the gear thereafter undergoes cathodic cleaning in a standard alkaline cleaning solution or the like for about sixty to ninety seconds. It has been found that an applied voltage in the range of about 4 to 6 volts during the cathodic cleaning provides good results. After the cathodic cleaning, the gear is thereafter rinsed in water and soaked in an acid solution of about sixty percent (by volume) hydrochloric acid solution for about 60 to 120 seconds. In one particularly preferred practice the acid solution is 60% of 37% reagent grade hydrochloric acid in water. However, other suitable acid solutions may be used if desired. The gear is thereafter rinsed in water and any remaining acid is neutralized by dipping the gear into the alkaline cathodic cleaning solution. The gear is thereafter rinsed and dried.

After the initial chemical cleaning the gear with a greatly softened scale surface is subjected to a vapor blasting surface treatment. Such a vapor blasting treatment involves accelerating a suspension of microscopic abrasive particles in water or other suitable fluid towards the treatment surface using compressed gas such as air to provide acceleration. During vapor blasting the particles of the suspension are dragged along the surface, removing a substantial portion of the soft residue on the surface. Large asperities across the surface may also be knocked down thereby further improving surface finish. Vapor blasting preferably should be done with particles that are softer than the softest constituent of the steel used for gear production. Moreover, the air pressure used in accelerating the particles is preferably set at levels so as to avoid potential damage to the surface. By way of example only, and not limitation, it has been found that good results are achieved by vapor blasting using a suspension of pumice particles (about 5 to 20%) in water wherein the gears are vapor blasted tooth-by-tooth using air pressure of between 20 to 60 psi.

It is believed that the combination of vapor blasting preceded by chemical cleaning substantially speeds up the vapor blasting process and improves its effectiveness. This improved effectiveness enables the use of such low hardness particles and low air pressures while still providing excellent scale removal performance. Thus, the potential for damaging the substrate material is greatly reduced without sacrificing scale removal performance. The steps of chemical cleaning and vapor blasting can be repeated if desired.

Following the initial chemical cleaning and vapor blasting, the gear is thereafter preferably subjected to a secondary or final chemical cleaning procedure. During this final chemical cleaning the gear is preferably subjected to cathodic cleaning for about 60 seconds in a standard alkaline cleaning solution to remove any pumice residue. Alternatively, after vapor blasting the gears may be immediately cleaned and dehydrated in anhydrous alcohol or a mixture of ethanol, 2-propanol and methanol in an ultrasound bath.

After the conclusion of vapor blasting and chemical cleaning the gear will normally retain only a thin oxide layer corresponding to the nascent oxide layer which forms on a clean metallic surface exposed to air. According to the potentially preferred practice, this oxide layer is removed by use of ion etching procedures under vacuum conditions. As will be appreciated, ion etching is a process in which accelerated ions are directed toward the substrate, strike it and remove small particles of the substrate. The thickness of material removed from the surface is very small and is normally in the order of nano-meters. Thus, even a thin oxide layer may be removed effectively without substantial removal of underlying substrate material. By way of example only, according to one contemplated practice ion etching may be done for about 30 minutes in a vacuum chamber filled with argon to a pressure of $10^{-3}$ torr, in plasma ignited in the chamber. The gears are provided with a negative accelerating voltage of about −400V with a small amount of Cr ions is added to the plasma.

Following practice of the procedures as outlined above, the oxide layer remaining after vapor blasting was approximately six times thinner than the layer left after chemical etching and eight times thinner than the layer left after heat treatment. The remaining layer was thereafter substantially removed by ion etching. The gear teeth were sufficiently clean to permit the application and adhesion of a wear and fatigue resistant coating such as chromium nitride, titanium nitride or the like by vapor deposition or other suitable techniques.

It is to be understood that while the present invention has been illustrated and described in relation to potentially preferred embodiments and procedures, that such embodiments and procedures are illustrative only and that the invention is in no event to be limited thereto. Rather, it is contemplated that modifications and variations embodying the principles of the invention will no doubt occur to those of ordinary skill in the art. It is therefore contemplated and intended that the present invention shall extend to all such modifications and variations as may incorporate the broad aspects of the invention within the true spirit and scope thereof.

The invention claimed is:

1. A method of treating a heat hardened alloy gear member at least partially covered with an oxide scale for acceptance of a protective coating, the method comprising the steps of:

(a) subjecting the alloy gear member to a chemical treatment comprising cathodic cleaning followed by acid etching to soften and at least partially dissolve the scale;

(b) vapor blasting the alloy gear member with a suspension of abrasive particles in a fluid suspension following the chemical treatment in step "a";

(c) cleaning the alloy gear member after vapor blasting to remove adhered particulate residue; and (d) subjecting the alloy gear member to ion etching in a vacuum chamber following step "c" to substantially remove any remaining oxide layer.

2. The invention as recited in claim 1, wherein in step "a" the cathodic cleaning is conducted in an alkaline solution.

3. The invention as recited in claim 2, wherein in step "a" the chemical treatment further comprises soaking the alloy gear member in an alkaline solution prior to cathodic cleaning.

4. The invention as recited in claim 2, wherein in step "a" the chemical treatment further comprises immersing the alloy gear member in an alkaline solution subsequent to acid etching to at least partially neutralize any remaining acid.

5. The invention as recited in claim 1, wherein the abrasive particles used in vapor blasting are softer than the alloy material forming the gear member.

6. The invention as recited in claim 5, wherein the abrasive particles used in vapor blasting are pumice particles.

7. The invention as recited in claim 5, wherein the vapor blasting is conducted using air pressures of about 20 to about 60 pounds per square inch.

8. The invention as recited in claim 1, wherein in step "c" the alloy gear member is cleaned by at least one of cathodic cleaning in an alkelyne solution or ultrasonic cleaning in an alcohol bath.

9. The invention as recited in claim 1, wherein in step "d" the ion etching is carried out in a plasma ignited in the vacuum chamber with chromium ions added to the plasma.

10. The invention as recited in claim 9, wherein in step "d" the ion etching is carried out at a pressure of about $10^{-3}$ torr.

11. The invention as recited in claim 9, wherein in step "d" a negative accelerating voltage is applied to the alloy gear member during ion etching.

12. A method of treating a heat hardened alloy gear member at least partially covered with an oxide scale for acceptance of a protective coating, the method comprising the steps of:

(a) subjecting the alloy gear member to a chemical treatment comprising the steps of soaking the alloy gear member in an alkaline solution, followed by cathodic cleaning of the alloy gear member, followed by acid etching of the alloy gear member to soften and at least partially dissolve the scale;

(b) vapor blasting the alloy gear member with a suspension of abrasive particles in a fluid suspension following the chemical treatment in step "a", wherein the particles used in vapor blasting are softer than the alloy material forming the alloy gear member;

(c) cleaning the alloy gear member after vapor blasting to remove adhered particulate residue; and (d) subjecting the alloy gear member to ion etching in a vacuum chamber following step "c" to substantially remove any remaining oxide layer, wherein the ion etching is carried out in a plasma ignited in the vacuum chamber with chromium ions added to the plasma.

13. The invention as recited in claim 12, wherein in step "a" the chemical treatment further comprises immersing the alloy gear member in an alkaline solution subsequent to acid etching to at least partially neutralize any remaining acid.

14. The invention as recited in claim 12, wherein the abrasive particles used in vapor blasting are pumice particles.

15. The invention as recited in claim 14, wherein the vapor blasting is conducted using air pressures of about 20 to about 60 pounds per square inch.

16. The invention as recited in claim 12, wherein in step "c" the alloy gear member is cleaned by at least one of cathodic cleaning in an alkelyne solution or ultrasonic cleaning in an alcohol bath.

17. The invention as recited in claim 12, wherein in step "d" the ion etching is carried out at a pressure of about $10^{-3}$ torr.

18. The invention as recited in claim 12, wherein in step "d" a negative accelerating voltage is applied to the alloy gear member during ion etching.

19. A method of treating a heat hardened alloy gear member at least partially covered with an oxide scale for acceptance of a protective coating, the method comprising the steps of:

(a) subjecting the alloy gear member to a chemical treatment comprising the steps of soaking the alloy gear member in an alkaline solution, followed by cathodic cleaning of the alloy gear member in an alkaline solution, followed by acid etching of the alloy gear member to soften and at least partially dissolve the scale;

(b) vapor blasting the alloy gear member with a suspension of pumice particles in a fluid suspension following the chemical treatment in step "a";

(c) cleaning the alloy gear member after vapor blasting to remove adhered particulate residue; and (d) subjecting the alloy gear member to ion etching in a vacuum chamber following step "c" to substantially remove any remaining oxide layer, wherein the ion etching is carried out in a plasma ignited in the vacuum chamber with chromium ions added to the plasma wherein a negative accelerating voltage is applied to the alloy gear member during ion etching.

* * * * *